US005139635A

United States Patent [19]

Signorini

[11] Patent Number: 5,139,635

[45] Date of Patent: Aug. 18, 1992

[54] ELECTROLYSER FOR THE PRODUCTION OF A GAS

[75] Inventor: Lido Signorini, Pise, Italy

[73] Assignee: Solvay et Cie, Brussels, Belgium

[21] Appl. No.: 628,434

[22] Filed: Dec. 14, 1990

[30] Foreign Application Priority Data

Dec. 28, 1989 [IT] Italy ..... 22868 A/89

[51] Int. Cl.[5] ..... C25B 9/00; C25B 15/08

[52] U.S. Cl. ..... 204/256; 204/258; 204/266; 204/270; 204/284

[58] Field of Search ..... 204/256, 258, 265-266, 204/270, 252-255, 257, 263-264, 284

[56] References Cited

U.S. PATENT DOCUMENTS 1,821,018 9/1931 Knowles ..... 204/270
3,925,186 12/1975 Giacopelli ..... 204/256
3,968,021 7/1976 Rahn et al. ..... 204/256
3,990,961 11/1976 Raetzsch et al. ..... 204/256 X
4,375,400 3/1983 Kircher ..... 204/258 X
4,505,789 3/1985 Ford ..... 204/270 X

*Primary Examiner*—Donald R. Valentine
*Attorney, Agent, or Firm*—Emmanuel J. Lobato; Robert E. Burns

[57] ABSTRACT

Electrolyser for the production of a gas, comprising a stack of vertical frames (1, 2) defining electrolysis chambers (4, 5), a degassing chamber (17) above the stack, a conduit for allowing electrolyte to enter (23) the degassing chamber, a vertical pipe (18) connecting the degassing chamber to the lower part of the electrolysis chambers and a nozzle (20) arranged around the pipe and connecting the degassing chamber to the upper part of the electrolysis chambers, the pipe (18) communicating with the degassing chamber (17) through a connecting conduit (19, 21) passing through the nozzle (20).

10 Claims, 4 Drawing Sheets

ELECTROLYSER FOR THE PRODUCTION OF A GAS

The invention relates to an electrolyser of the filter-press type for the electrolytic production of a gas.

Electrolysers of the filter-press type are generally made up of a stack of vertical frames which define alternately anodic and cathodic electrolysis chambers in which the electrodes are arranged vertically. Selectively permeable membranes or diaphragms permeable to electrolytes may be inserted between the frames to separate the electrolysis chambers. In these electrolysers gas is generated at the electrodes and an emulsion of electrolyte in the gas is generally collected at the exit of the electrolysis chambers. The emulsion must be treated in a degassing chamber to separate the gas from the entrained electrolyte.

In documents EP-A-0,052,880 and EP-A-0,053,807 (Olin Corporation), there is a description of electrolysers of the type defined above, in which two degassing chambers are arranged above the stack of frames. One of the degassing chambers communicates with anodic electrolysis chambers, while the other degassing chamber communicates with the cathodic electrolysis chambers. The communication between the degassing chambers and the electrolysis chambers comprises, on the one hand, nozzles opening into the upper part of the electrolysis chambers and used for transferring the emulsion from the electrolysis chambers towards the degassing chamber and, on the other hand, a pipe opening into the lower part of the electrolysis chambers and used for recycling into the latter the electrolyte separated from gas. The degassing chambers are, furthermore, in communication with a conduit for allowing fresh electrolyte to enter.

In these known electrolysers the presence of a nozzle and of a pipe which are separated between each electrolysis chamber and the degassing chambers gives rise to a large bulk and complicates the structure of the electrolyser.

The invention overcomes this disadvantage of known electrolysers as described above, by providing an electrolyser of the filter-press type, equipped with at least one degassing chamber for the separation of the electrolyte entrained with the gas produced in the electrolysis chambers, which is of reduced bulk and simpler in structure.

The invention consequently relates to an electrolyser for the production of a gas, comprising a stack of vertical frames defining adjoining individual electrolysis chambers which are alternately anodic and cathodic and each of which contains at least one electrode, at least one degassing chamber arranged above the stack and connected to each of the anodic (or cathodic) electrolysis chambers by a nozzle opening into the upper part of the electrolysis chamber and by a pipe opening into the lower part of the electrolysis chamber, and a conduit for allowing electrolyte to enter the degassing chamber; according to the invention the nozzle is arranged around the pipe so that the upper end of the nozzle is above the upper end of the pipe, and the pipe communicates with the degassing chamber by means of a connecting conduit or passageway passing through the side wall of the pipe and that of the nozzle.

In the electrolyser according to the invention the frames form the side wall of the electrolysis chambers. They may take any outline compatible with the structure of an electrolyser of the filter-press type. They may have an outline which is circular or polygonal, for example square, trapezoidal or rectangular, this being of no consequence. They must be made of a material which stands up chemically to the conditions of electrolysis.

The degassing chamber is connected to all the anodic (or cathodic) electrolysis chambers, in which a gas is generated at the electrode. Its function is to collect the gas produced at the electrodes, to separate off the electrolyte entrained with the gas and to recycle this electrolyte into the electrolysis chambers. The degassing chamber is connected, furthermore, to a conduit for allowing fresh electrolyte to enter and thus serves as a transit chamber for feeding electrolysis chambers with fresh electrolyte. In the case where a gas is generated in all the electrolysis chambers the electrolyser may comprise two degassing chambers, one of these being in communication with the anodic electrolysis chambers, while the other is connected to the cathodic electrolysis chambers.

The connection between the degassing chamber and the electrolysis chambers comprises nozzles which are in communication with the upper part of the electrolysis chambers and pipes which are in communication with the lower part of the said chambers. The upper part of the electrolysis chamber means the upper half of its height; the lower part of the electrolysis chamber means the lower half of its height. Nozzles are used for passing gas from the electrolysis chambers into the degassing chamber, whereas the pipes serve for feeding the electrolysis chambers with fresh electrolyte and for recycling into them the electrolyte separated from the gas in the degassing chamber.

According to the invention, in the case of each electrolysis chamber which is connected to the degassing chamber, the nozzle is arranged around the pipe and its upper end or edge is situated at a level which is higher than that of the upper end of the pipe. A connecting conduit or passageway passing through the wall of the nozzle and that of the pipe brings the latter into communication with the degassing chamber. While the electrolyser is in operation, the electrolyte settles at the level of the abovementioned connecting conduit, with the result that the electrolysis chambers are completely filled with electrolyte. The gas leaving the electrolysis chambers enters the degassing chamber via the nozzles, the electrolyte which separates off from the gas at the exit of the nozzles falls back into the degassing chamber, where it is mixed with fresh electrolyte originating from the entry conduit, and the mixture of electrolyte flows into each pipe via the abovementioned connecting conduit and is thus introduced into the electroylsis chambers.

In a particular embodiment of the electrolyser according to the invention, the connecting conduit between the pipe and the degassing chamber is obtained by placing a part of the wall of the pipe closely against a part of the wall of the nozzle and by piercing an opening through the adjacent walls. This embodiment of the invention makes it easier to construct the electrolyser.

In a particular embodiment of the electrolyser according to the invention, the degassing chamber contains a horizontal or sloping partition through which the nozzles pass so as to form a baffle in the electrolyte circuit between the outlet of the nozzles and its entry into the pipe. In this embodiment of the invention, the effect of the baffle or is to lengthen the electrolyte circuit in the degasssing chamber, and this improves the homogeneity of the mixture of the fractions of electrolyte leaving the nozzles.

In another embodiment of the electrolyser according to the invention, the nozzle emerges into a channel defined inside an upper horizontal lengthwise girder of the frame of the electrolysis chamber, and the pipe emerges into a channel defined in a lower horizontal lengthwise girder of the said frame, the two channels being in communication with the electrolysis chamber. In an advantageous alternative form of this embodiment the two channels are connected by vertical tubes situated in the electrolysis chamber. In this alternative form of the invention the vertical tubes have a twin function. On the one hand, they take part in the circulation of the electrolyte into the electrolysis chamber; on the other hand, they form struts strengthening the rigidity of the electrolysis chamber and of the electrode.

In the electrolyser according to the invention, the arrangement of the nozzle around the pipe considerably reduces the bulk and, in accordance with an advantageous embodiment of the invention, makes it possible to construct the degassing chamber in the form of a tubular enclosure arranged transversely relative to the frames.

The electrolyser according to the invention is suitable for all electrolysis processes in which a gas is generated in at least a part of the electrolysis chambers. The invention applies very particularly to the electrolysers for the production of chlorine and of aqueous sodium hydroxide solutions, in which the anodic electrolysis chambers are separated from the cathodic electrolysis chambers by ionic separators. The ion separators employed in the electrolysers according to the invention are sheets inserted between the electrolysis chambers and made of a material capable of allowing an ion current to pass through it while the electrolyser is in operation. They may be diaphragms which are permeable to aqueous electrolytes, or selectively permeable membranes.

Examples of diaphragms which can be employed in the electrolysers according to the invention are asbestos diaphragms such as those described in U.S. Pat. No. 1,855,497 (Stuart) and in Patents FR-A-2,400,569, EP-A-1,644 and EP-A-18,034 (Solvay & Cie) and diaphragms made of organic polymers, such as those described in Patents FR-A-2,170,247 (Imperial Chemical Industries PLC) and in Patents EP-A-7,674 and EP-A-37,140 (Solvay & Cie).

Selectively permeable membranes means nonporous, thin membranes comprising an ion exchange substance. The choice of the material constituting the membranes and the ion exchange substance will depend on the nature of the electrolytes subjected to the electrolysis and of the products which it is intended to obtain. As a general rule, the material of the membranes is chosen from those which are capable of withstanding the thermal and chemical conditions normally prevailing in the electrolyser during the electrolysis, the ion exchange substance being chosen from anion-exchanger substances or cation-exchanger substances, depending on the electrolysis operations for which the electrolyser is intended.

For example, in the case of electrolysers intended for the electrolysis of aqueous sodium chloride solutions for the production of chlorine, hydrogen and aqueous sodium hydroxide solutions, membranes which are suitable are cationic membranes made of fluoro, preferably perfluorinated, polymer, containing cationic functional groups derived from sulphonic acids, carboxylic acids or phosphonic acids or from mixtures of such functional groups. Examples of membranes of this type are those described in Patents GB-A-1,497,748 and GB-A-1,497,749 (Asahi Kasei Kogyo K.K.), GB-A-1,518,387, GB-A-1,522,877 and U.S. Pat. No. 4,126,588 (Asahi Glass Company Ltd) and GB-A-1,402,920 (Diamond Shamrock Corp.). Membranes which are particularly suited to this application of the cell according to the invention are those known under the names "Nafion" (Du Pond de Nemours & Co) and "Flemion" (Asahi Glass Company Ltd).

Special features and details of the invention will emerge from the description which follows, with reference to the attached drawings.

In these figures, the same reference numbers indicate similar components.

In the description which follows, the invention is applied specifically to the monopolar electrolysers of the filter-press type with cationic membranes, for the production of chlorine, hydrogen and aqueous sodium hydroxide solutions by electrolysis of aqueous sodium chloride solutions.

Figure 1:
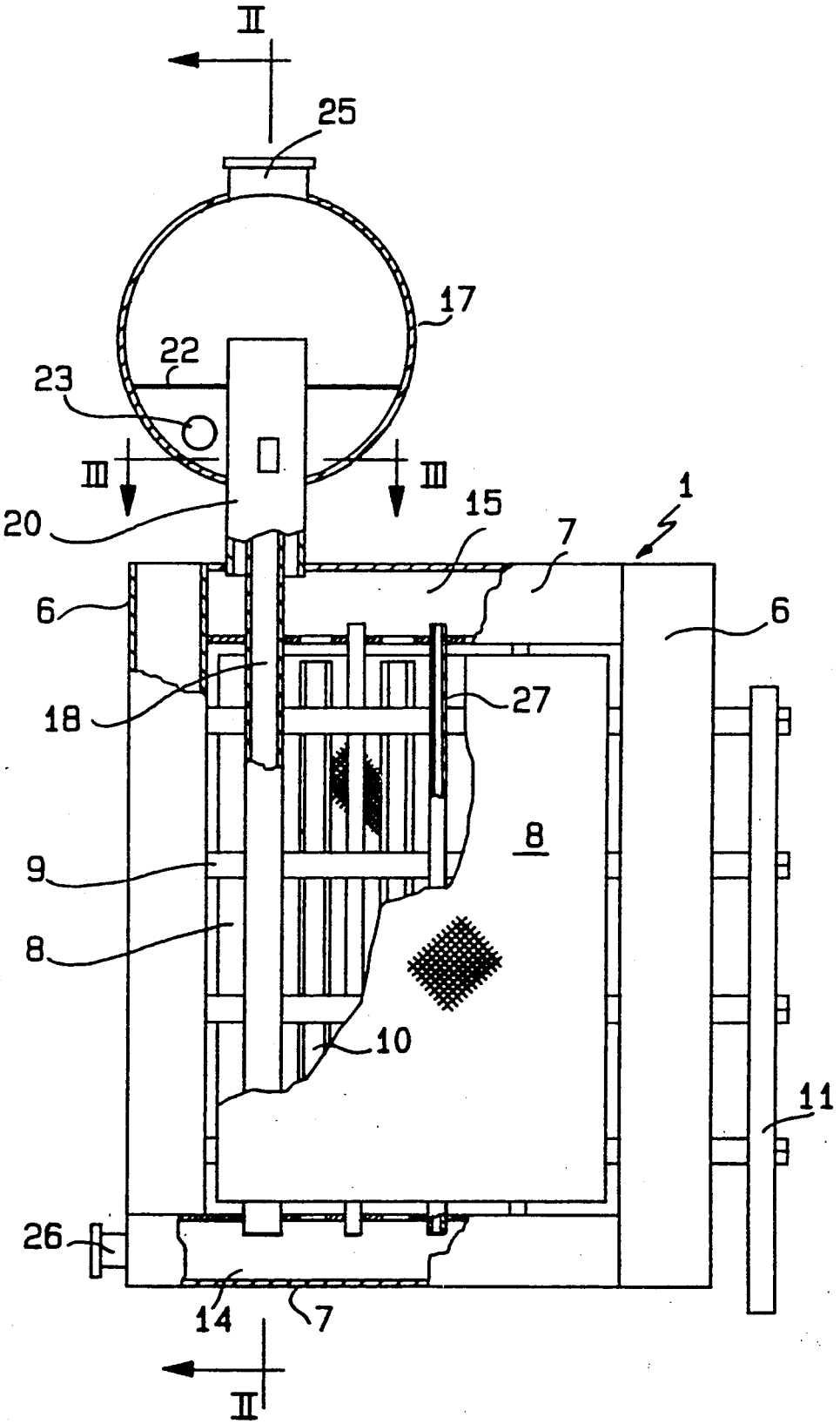
FIG. 1 is an elevation view, with cutaway, of a particular embodiment of the electrolyser according to the invention.
Figure 2:
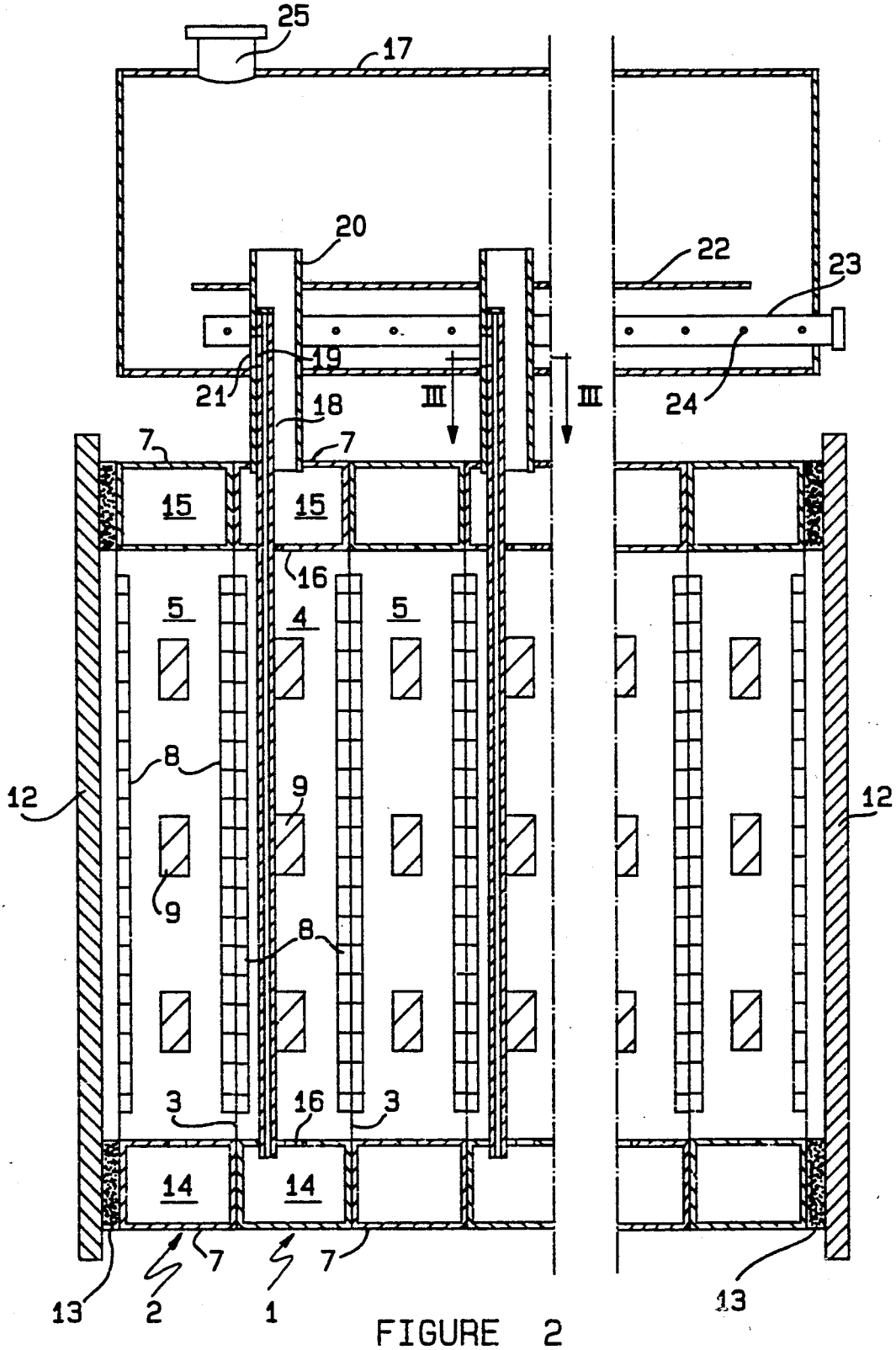
FIG. 2 is a vertical section along the plane II—II of FIG. 1.
Figure 3:
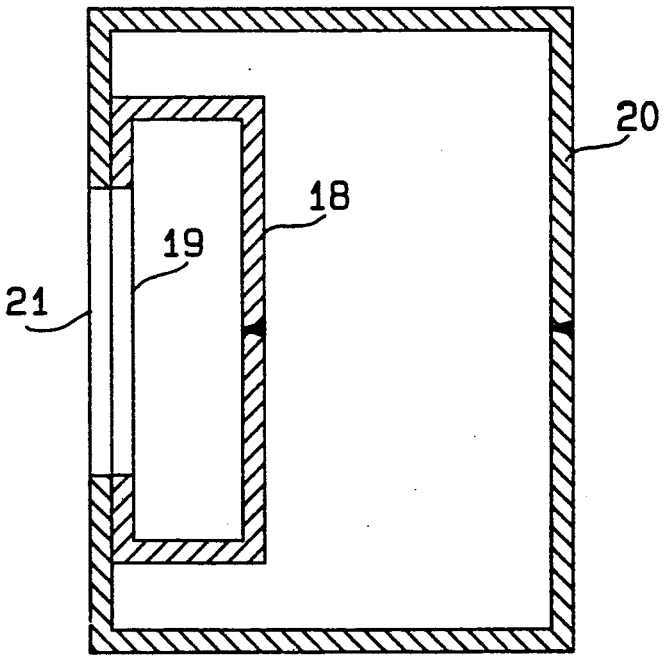
FIG. 3 shows a detail of the electrolyser of FIGS. 1 and 2 on a large scale and in section along the plane III—III of FIGS. 1 and 2.

The electrolyser shown in FIGS. 1 to 3 is made up of a stack of alternately anodic 1 and cathodic 2 vertical frames. Selectively permeable membranes 3 are inserted between the frames 1 and 2 to define alternately anodic 4 and cathodic 5 electrolysis chambers containing electrodes.

The frames 1 and 2 are rectangular in cross-section. They are made up of two vertical uprights 6 welded to two horizontal lengthwise girders 7. In the case of the anodic frames 1, the uprights 6 and the lengthwise girders 7 are made of titanium, whereas in the case of the cathodic frames 2, they are made of nickel.

The electrodes are of the type of those described in Belgian Patent Application 08900867 (Solvay & Cie). Each comprises a pair of vertical metal sheets 8 made of expanded metal, which are arranged on each side of a number of horizontal metal bars 9. The metal sheets 8 are welded to vertical beams 10 made up of metal strips folded into a U or into an Ω shape. The beams 10 are welded to the horizontal bars 9 and the latter are welded to the uprights 6 of the frames, through which they pass. They are attached together to a connecting rod 11 intended to be coupled to a source of current. The bars 9 and the beams 10 thus interact in coupling the metal sheets 8 to the source of current and in supporting these metal sheets inside the electrolysis chamber.

The material of the metal sheets 8, of the bars 9 and the vertical beams 10 depends on the destination of the electrode. In the case of the anodes, the metal sheets 8 are made of titanium and carry an electrically conductive coating with a low overvoltage for the electrochemical oxidation of chloride ions, the bars 9 comprise a copper core enclosed in a titanium jacket, and the vertical beams 10 are made of titanium. In the case of the cathodes, the metal sheets 8 are made of nickel, the bars 9 comprise a copper core enclosed in a nickel jacket, and the vertical beams 10 are made of nickel.

The stack of the frames 1 and 2 and of the membranes 3 is held between two end flanges 12 connected by tie rods, not shown, with seals 13 providing the leakproofing.

The lengthwise girders 7 of the frames 1 and 2 are hollow, so as to define internal channels of square or rectangular section, 14 in the case of the lower lengthwise girder and 15 in the case of the upper lengthwise girder respectively. The channels 14 and 15 communicate with the electrolysis chambers 4 and 5 via openings 16, made in the wall of the lengthwise girders. In each electrolysis chamber 4 or 5, the two channels 14 and 15 are, furthermore, connected by vertical tubes 27 arranged inside the electrolysis chamber, between the two metal sheets 8 of the electrode.

A degassing chamber 17 is arranged above the stack. It is in the shape of a horizontal tubular enclosure arranged transversely relative to the frames 1 and 2. The degassing chamber 17 communicates with the lower channel 14 of each anodic chamber 4 by means of a vertical pipe 18 shut off at its upper end and pierced with a side opening 19. It also communicates with the upper channel 15 by means of a vertical nozzle 20. The nozzle 20 is arranged around the pipe 18 so that its upper edge is situated at a level higher than that of the upper edge of the pipe 18.

FIG. 3 shows the assembly of the pipe 18 and of the nozzle 20 in horizontal cross-section. The pipe 18 and the nozzle 20 have a rectangular cross-section and are obtained by folding a titanium sheet. The nozzle 20 is applied against the face of the pipe 18 in which the opening 19 is pierced. An opening 21 is pierced through the wall of the nozzle 20, facing the opening 19 of the pipe 18, so that the pipe 18 communicates with the degassing chamber by means of the two openings 19 and 21.

Inside the degassing chamber 17 the nozzles pass through a horizontal partition 22. A horizontal tube 23 pierced by openings 24 is arranged under the partition 22. The tube 23 passes through the end wall of the degassing chamber, to be connected to a conduit (not shown) for allowing an aqueous sodium chloride solution to enter.

A pipe 25 opens into the upper part of the degassing chamber. It is used for removing the chlorine produced during the electrolysis.

The electrolyser may comprise a second degassing chamber (not shown) similar to the degassing chamber 17 and connected to the cathodic chambers 5 by pipes and nozzles which are similar to the pipes 18 and nozzles 20.

While the electrolyser shown in FIGS. 1 to 3 is in operation, an aqueous sodium chloride solution is introduced into the degassing chamber 17 through the tube 23. When the sodium chloride solution in the degassing chamber 17 reaches the level of the openings 19 and 21, it flows into the anodic electrolysis chambers, through the pipes 18, the lower channels 14 and the openings 16 in the latter. Chlorine is generated on the metal sheets 8 of the anodes and flows into the degassing chamber, rising through the electrolyte in the chambers 4, the channels 15 and the nozzles 20. On leaving the nozzles 20, the electrolyte entrained with the chlorine separates from the latter and falls back into the degassing chamber, where it mixes with the fresh electrolyte originating from the tube 23. The partition 22 forms a baffle lengthening the path followed by the electrolyte separated off from the chlorine, and this ensures a better homogeneity of the sodium chloride solution introduced into the anodic electrolysis chambers 4. The chlorine separated off from the electrolyte escapes from the degassing chamber through the orifice 25. An electrolyte fraction corresponding to the quantity introduced through the entry tube 26 is drawn off from the anodic chambers 4 through a tube 26 in communication with the channels 14.

In parallel with the production of chlorine in the anodic chambers 4, hydrogen is generated in the cathodic chambers 5. For this purpose, water or a dilute aqueous sodium hydroxide solution is introduced into the cathodic chambers 5, and a fraction of a concentrated sodium hydroxide solution, corresponding to the quantity of water or of dilute solution introduced into the electrolysis chambers, is removed from the cathodic chambers through the lower channels 14. A concentrated aqueous sodium hydroxide solution is, furthermore, separated off from the hydrogen in a degassing chamber similar to the chamber 17 and is redirected into the cathodic chambers 5.

In the electrolyser, the vertical tubes 27 perform a twin function. On the one hand, they are used to give rise to an internal circulation of electrolyte inside the electrolysis chambers; on the other hand, they form stiffeners between the metal sheets 8 of the electrodes, counteracting any distortion of these metal sheets under the effect of the pressure prevailing in the electrolysis chamber. The vertical tubes 27 consequently make it possible to construct electrolysis chambers of very great width, without the risk of bending the metal sheets 8 of the electrodes.

Figure 4:
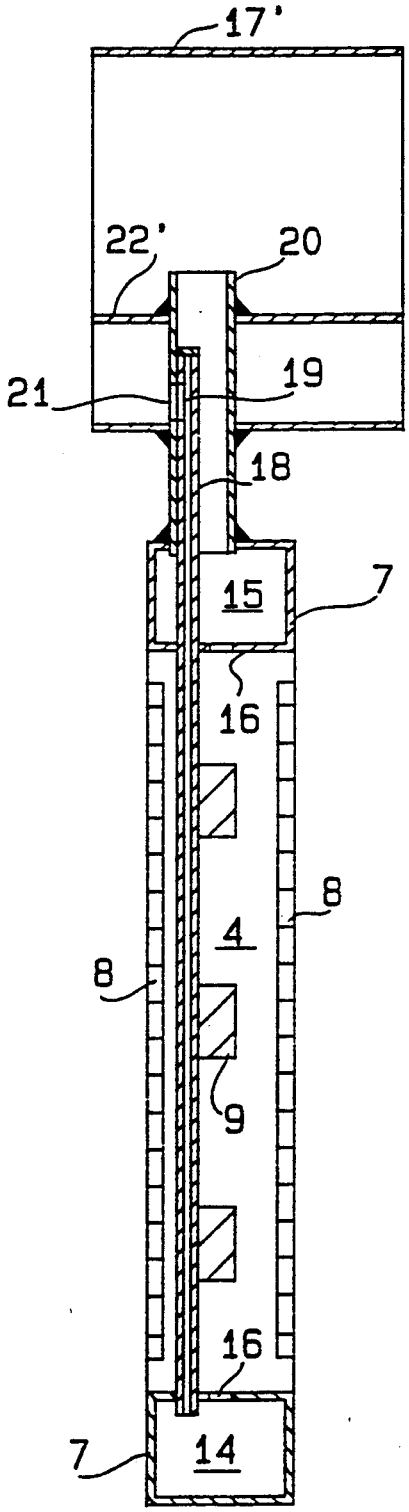
FIG. 4 is a view similar to FIG. 2, of a unit length of another embodiment of the electrolyser according to the invention.

In an alternative embodiment, not shown, of the electrolyser of FIGS. 1 to 3, the degassing chamber is made up of a stack of adjoining tubular lengths compressed between to end flanges. In this alternative form of the invention, it is possible to imagine joining each length of the degassing chamber integrally to a frame 1 of the electrolyser, so as to produce an integrated assembly. FIG. 4 shows such an integrated assembly. It comprises an anodic frame 1, a length 17' of the degassing chamber 17, a length 22' of the partition 22, a pipe 18 and a nozzle 20. The cohesion of the integrated assembly is ensured by the nozzle 20 to which the frame 1 and the lengths 17' and 22' are welded.

I claim:

1. An electrolyser for the production of a gas comprising:

a stack of vertical frames defining adjoining electrolysis chambers which are alternately anodic and cathodic and each contains at least one electrode, at least one degassing chamber disposed above the stack and connected to each of the anodic or cathodic electrolysis chambers, each electrolysis chamber having a nozzle and a pipe providing communication between an upper part and a lower part respectively of a corresponding electrolysis chamber and said degassing chamber, and a conduit for introducing electrolyte into the degassing chamber, the improvement comprising, each said nozzle being disposed circumferentially of a corresponding said pipe and an upper end of said nozzle is above an upper end of said corresponding pipe and each said nozzle and each said corresponding pipe having a passageway on a side wall thereof below the level of each said upper end thereof respectively providing communication between each said nozzle and the interior of said degassing chamber.

2. An electrolyzer for the production of a gas according to claim 1, in which each said nozzle and each said corresponding pipe therein have adjoining wall portions, each said passageway in the wall portion of each said nozzle is an opening, and the passageway in each wall portion of each said corresponding pipe is an opening in registry with the opening of a corresponding nozzle.

3. An electrolyzer for the production of a gas according to claim 1 or 2, in which said degassing chamber comprises a tubular enclosure disposed horizontally transversely of said frames.

4. An electrolyzer for the production of a gas according to claims 1, 2, or 3, further including a partition in said degassing chamber defining a baffle, and each said nozzle extends through said baffle.

5. An electrolyzer for the production of a gas according to claims 1, 2, 3 or 4, in which said conduit comprises a tube having perforations axially spaced thereon.

6. An electrolyzer for the production of a gas according to claims 1, 2, 3, 4 or 5, in which each frame of a corresponding electrolysis chamber comprises an upper horizontal lengthwise girder defining an upper channel and a lower horizontal lengthwise girder defining a lower channel, means providing communication between a corresponding electrolysis chamber and the upper channel and the lower channel thereof, each nozzle of a corresponding electrolysis chamber opens into said upper channel thereof, and each said pipe of a corresponding electrolysis chamber opens into said lower channel thereof.

7. An electrolyzer for the production of a gas according to claim 6, in which said means providing communication between a corresponding electrolysis chamber and the upper channel and the lower channel thereof comprising tubes disposed internallly of the corresponding electrolysis chamber extending between the respective upper channel and the lower channel thereof.

8. An electrolyzer for the production of a gas according to claim 6, in which each said electrolysis chamber comprises at lest one pair of vertical perforated metal sheets disposed facing each other and defining at least a part of the electrode of the respective electrolysis chamber.

9. An electrolyzer according to any one of claims 1 to 8, further including a second degassing chamber, means for connecting one of the degassing chambers to the anodic electrolysis chambers, means connecting the other of said degassing chambers to the cathodic electrolysis chambers, and ion separators disposed between the electrolysis chambers.

10. An electrolyzer according to any one of claims 1 to 9, in which material used in the construction of said electrolyzer comprise materials selected for their capability of withstanding thermal and chemical conditions for the electrolysis of aqueous sodium chloride solutions.

* * * * *